US011014704B1

(12) United States Patent
Beales

(10) Patent No.: US 11,014,704 B1
(45) Date of Patent: May 25, 2021

(54) QUAD PLY CORNER OCTAGON TRAY

(71) Applicant: WestRock Shared Services, LLC, Atlanta, GA (US)

(72) Inventor: Jonathan T. Beales, Atlanta, GA (US)

(73) Assignee: WESTROCK SHARED SERVICES, LLC, Atlanta, GA (US)

( * ) Notice: Subject to any disclaimer, the term of this patent is extended or adjusted under 35 U.S.C. 154(b) by 0 days.

(21) Appl. No.: 16/902,758

(22) Filed: Jun. 16, 2020

(51) Int. Cl.
*B65D 5/32* (2006.01)
*B65D 5/42* (2006.01)

(52) U.S. Cl.
CPC ..... *B65D 5/32* (2013.01); *B65D 5/4266* (2013.01); *B65D 5/4295* (2013.01)

(58) Field of Classification Search
CPC ..... B65D 5/32; B65D 5/029; B65D 5/445; B65D 15/22; B65D 2519/00815; B65D 77/061
USPC ..... 229/122.21, 109, 199, 920, 122.33, 229/125.26, 186, 188, 192; 206/386
See application file for complete search history.

(56) References Cited

U.S. PATENT DOCUMENTS 4,614,298 A * 9/1986 Cherry ..... B65D 5/10 229/109
5,044,549 A 9/1991 Beales
5,489,061 A 2/1996 Fogle
5,628,450 A * 5/1997 Cromwell ..... B65D 5/06 229/109
5,772,108 A 6/1998 Ruggiere, Sr. et al.
6,220,508 B1 4/2001 Wisser
6,938,820 B2 9/2005 Noone
7,604,156 B2 10/2009 Clohessy
7,681,781 B2 3/2010 Wisecarver
8,011,565 B2 9/2011 Quaintance
8,025,208 B2 * 9/2011 Wisecarver ..... B65D 5/14 229/117.3
8,579,778 B2 11/2013 Aganovic et al.
8,690,048 B2 4/2014 Philips
8,820,618 B2 9/2014 Smith
8,827,142 B2 9/2014 Smith
8,978,964 B1 3/2015 Ruggiere, Sr.
9,452,861 B2 9/2016 Smith
9,815,586 B2 11/2017 Graham et al.
2002/0096559 A1 * 7/2002 Quaintance ..... B65D 5/029 229/109
2016/0221710 A1 * 8/2016 McDonnell ..... B65D 5/4295

* cited by examiner

*Primary Examiner* — Christopher R Demeree
(74) *Attorney, Agent, or Firm* — Neil G. Cohen; John B. Swingle

(57) ABSTRACT

A container comprises, a first blank section including a first side panel with an opposed pair of corner panels extending form opposite ends of the first side panel. The container comprises a second blank section including a front panel with an opposed pair of corner panels extending from opposite sides of the front panel. One of the corner panels of the first side panel is adhered to one of the side panels of the front panel, forming a first double-thickness corner panel.

16 Claims, 13 Drawing Sheets

Fig. 8
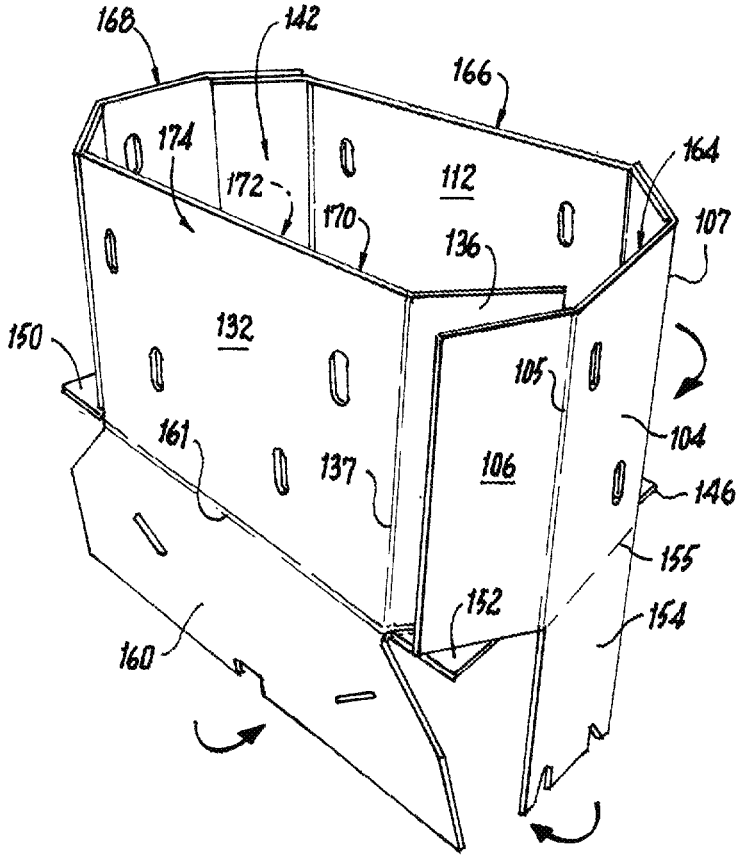
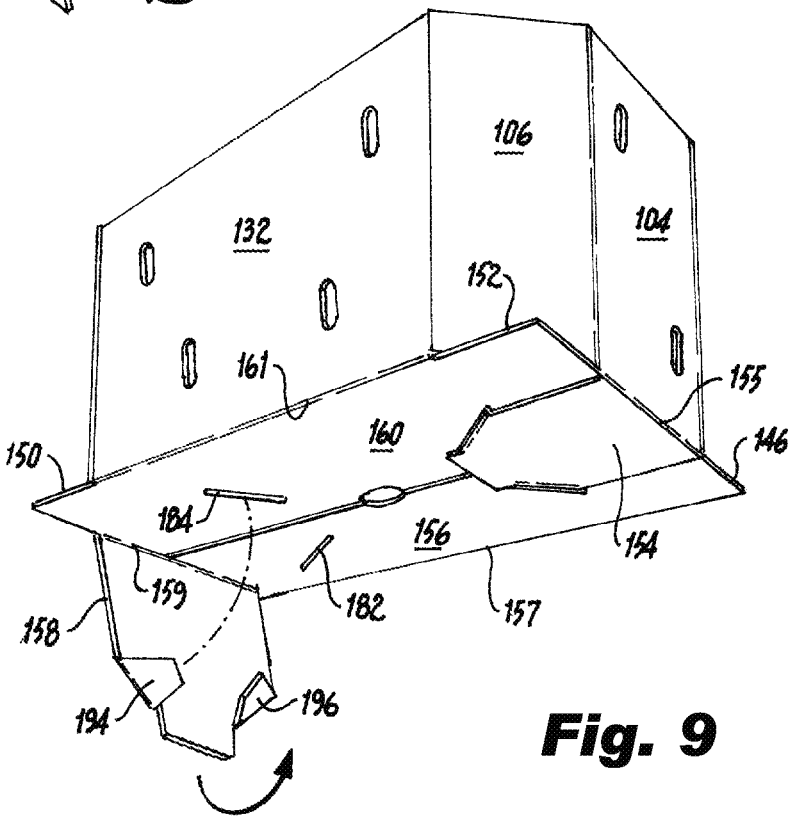
Fig. 9

Fig. 15
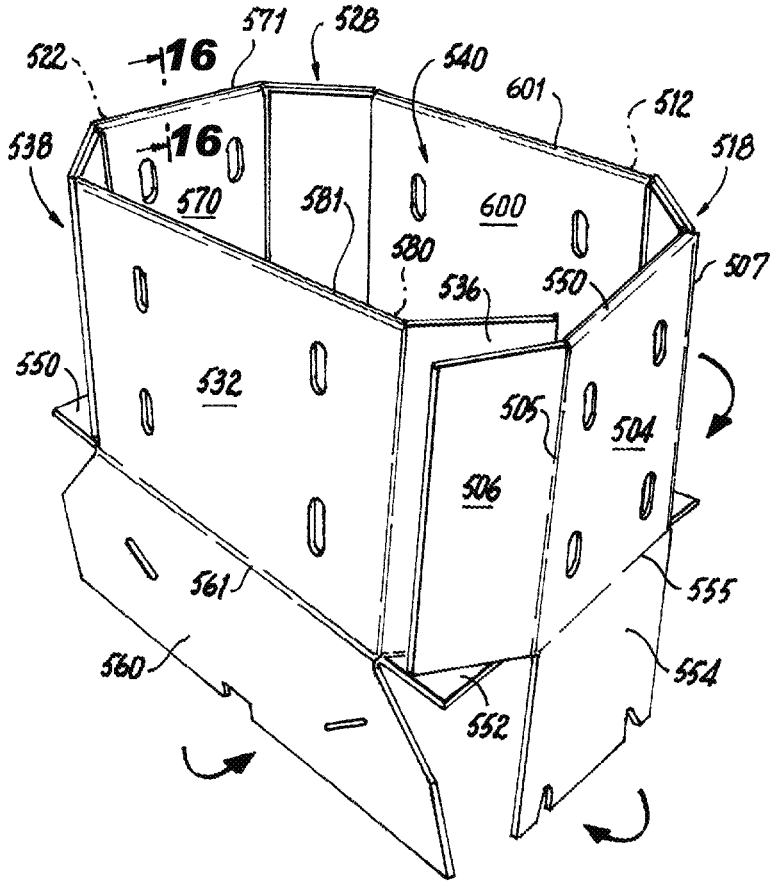
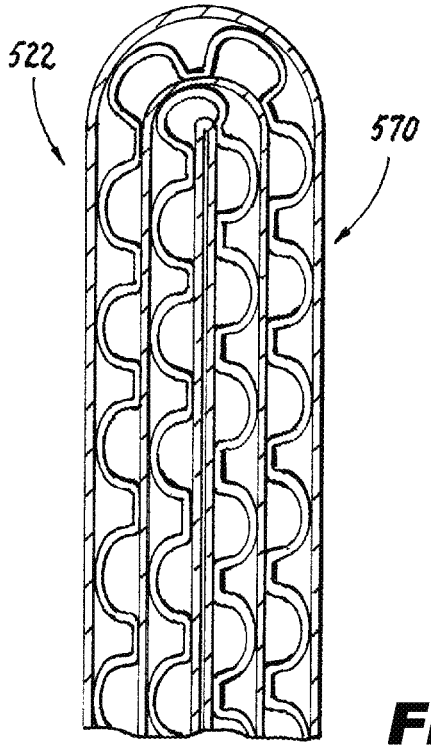
Fig. 16

QUAD PLY CORNER OCTAGON TRAY

BACKGROUND OF THE INVENTION

1. Field of the Invention

The present disclosure relates to containers, and more particularly to stackable retail ready containers.

2. Description of Related Art

Retail ready containers can be used to package and ship product to retail locations. In the retail setting, such containers used to display the product without the need for conversion from the shipping container, or transfer between containers. Consumers can access and remove product directly from the converted container, e.g., from an interior space of the container after placement on the retail floor.

Wholesalers and retailers benefit from having a shipping container function as the retail container. In order to function as both roles, the container must be able to withstand substantial weight stacked on top, as well as vibrations and turbulence during shipping. Conventional methods include using triple wall thickness corrugate, however, triple wall corrugated paper is costly and can be difficult to obtain and process. There remains a need in the art for containers suitable for stacking having improved compression strength and shear strength, without relying on triple wall corrugate.

The conventional techniques have been considered satisfactory for their intended purpose. However, there is an ever present need for improved containers. This disclosure provides a solution for this need.

SUMMARY

A container comprises, a first blank section including a first side panel with an opposed pair of corner panels extending form opposite ends of the first side panel. The container comprises a second blank section including a front panel with an opposed pair of corner panels extending from opposite sides of the front panel. One of the corner panels of the first side panel is adhered to one of the side panels of the front panel, forming a first double-thickness corner panel.

The container can also comprise a third blank section including a second side panel opposite the first side panel with an opposed pair of corner panels extending from opposite sides of the second side panel. One of the corner panels of the second side panel can be adhered to one of the corner panels of the front panel, which can form a second double-thickness corner panel.

The container can comprise a fourth blank section including a back panel with an opposed pair of corner panels extending from opposite sides of the back panel. One of the corner panels of the back panel can be adhered to one of the corner panels of the second side panel, which can form a third double-thickness corner panel. One of the corner panels of the back panel can be adhered to one of the corner panels of the first side panel, which can form a fourth double thickness corner panel. The first side panel, front panel, second side panel, and back panel can cooperate to surround an interior space for containing product.

Each of the first, second, third, and fourth blank sections can be of double-wall corrugated paper, so that the first, second, third, and fourth double-thickness corner panels have a total two double-wall corrugated paper for a total of four plies thickness in each corner. Each corner panel of the front and back panels can include a triangular bottom flap extending outward from the respective double-wall thickness corner panel.

The container can further include, a first bottom flap extending from a bottom edge of the first side panel, a second bottom flap extending from a bottom edge of the front panel, a third bottom flap extending from a bottom edge of the second side panel, and a fourth bottom flap extending from a bottom edge of the back panel, wherein the first, second, third, and fourth bottom flaps can overlap to form a bottom panel.

The top edges of the first side panel, front panel, second side panel, and back panel can form a top opening into the interior space. The top edges can be free of panels extending therefrom. At least one of the top edges can include an interior panel extending from the top edge and folded over into the interior space, so print can appear on interior and exterior surfaces of the container while only one side of the first, second, third, and fourth blank sections need be printed.

A system includes a container of double wall corrugated paper that includes four of upright panels formed about an interior space, wherein the upright panels are connected by four corner panels, wherein the four upright panels and the four corner panels are configured to support a load of 1200 pounds (544 kg) bearing down on the four upright panels and the four corner panels.

The container can be a first container and the system can further include a pallet on top of the first container and a second container on top of the pallet. The pallet and second container can weigh at least 1200 pounds (544 kg). The system can include a second pallet on top of the second container and a third container on top of the second pallet. The second pallet and third container can weigh at least 1200 pounds (544 kg). The first container can be free of triple wall corrugated material.

A blank includes a first blank section including a first side panel with an opposed pair of corner panels extending form opposite ends of the first side panel. The blank can include a second blank section including a front panel with an opposed pair of corner panels extending from opposite sides of the front panel. One of the corner panels of the first side panel can be adhered to one of the side panels of the front panel, which can form a first double-thickness corner panel.

The blank can include a third blank section including a second side panel opposite the first side panel with an opposed pair of corner panels extending from opposite sides of the second side panel. One of the corner panels of the second side panel can be adhered to one of the corner panels of the front panel, which can form a second double-thickness corner panel.

The blank can include a fourth blank section including a back panel with an opposed pair of corner panels extending from opposite sides of the back panel. One of the corner panels of the back panel can be adhered to one of the corner panels of the second side panel, which can form a third double-thickness corner panel. One of the corner panels of the back panel can be configured to be adhered to one of the corner panels of the first side panel, which can form a fourth double thickness corner panel. The first side panel, front panel, second side panel, and back panel can be configured to cooperate to surround an interior space for containing product.

Each of the first, second, third, and fourth blank sections can be double-wall corrugated paper, so that the first, second, and third double-thickness corner panels can have a total two double-wall corrugated paper for a total of four plies thickness. Each corner panel of the front and back panels can include a triangular bottom flap extending outward therefrom.

The blank can include a first bottom flap extending from a bottom edge of the first side panel, a second bottom flap extending from a bottom edge of the front panel, a third bottom flap extending from a bottom edge of the second side panel, a fourth bottom flap extending from a bottom edge of the back panel. The first, second, third, and fourth bottom flaps can be configured to overlap to form a bottom panel.

The top edges of the first side panel, front panel, second side panel, and back panel can be free of panels extending therefrom. At least one of top edges of the first side panel, front panel, second side panel, and back panel can include an interior panel extending from the top edge and folded over into the interior space, so print can appear on interior and exterior surfaces of the container. Only one side of the first, second, third, and fourth blank sections need be printed.

One of the corner panels of the back panel can be configured to be adhered to one of the corner panels of the first side panel, forming a fourth double thickness corner panel. The first side panel, front panel, second side panel, and back panel can be folded into a flat, palletizable form configured to be erected into a container. Each of the first, second, third, and fourth blank portions can be devoid of triple wall corrugated paper.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein:

FIG. 8 is a rear perspective view of the attached blank of FIG. 6, showing the formation of the container of FIG. 1;

FIG. 9 is a bottom rear perspective view of the formed container of FIG. 1;

FIG. 15 is a rear perspective view of the blank of FIG. 13 showing the formation of the container of FIG. 11; and FIG. 16 is a magnified cross section of a portion of a wall of the container of FIG. 11 showing two layers of double wall corrugate.

DETAILED DESCRIPTION OF THE PREFERRED EMBODIMENTS

Figure 1:
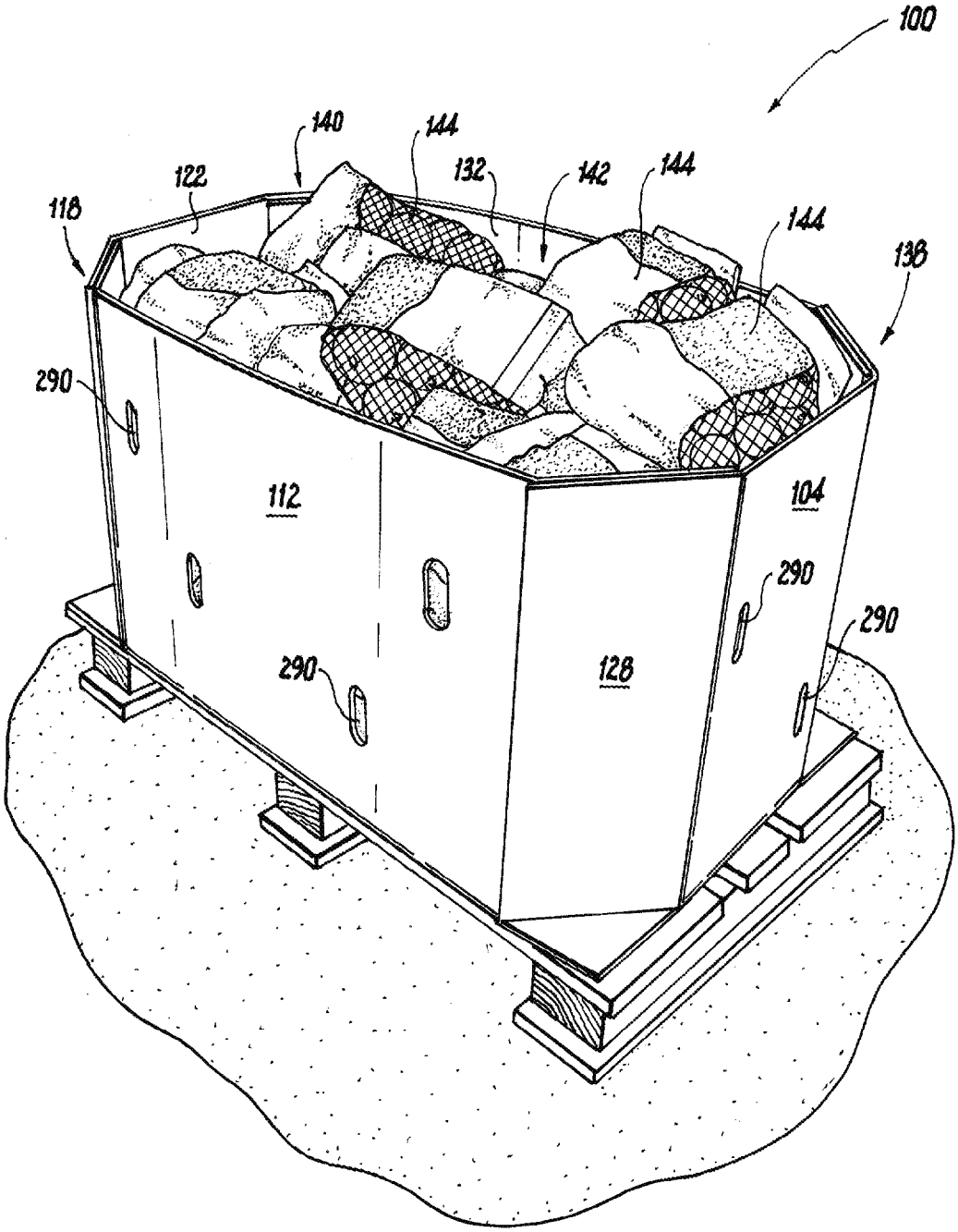
FIG. 1 is a perspective view of an embodiment of a container constructed in accordance with the present disclosure, showing a container holding a product stacked on a palette.
Figure 2:
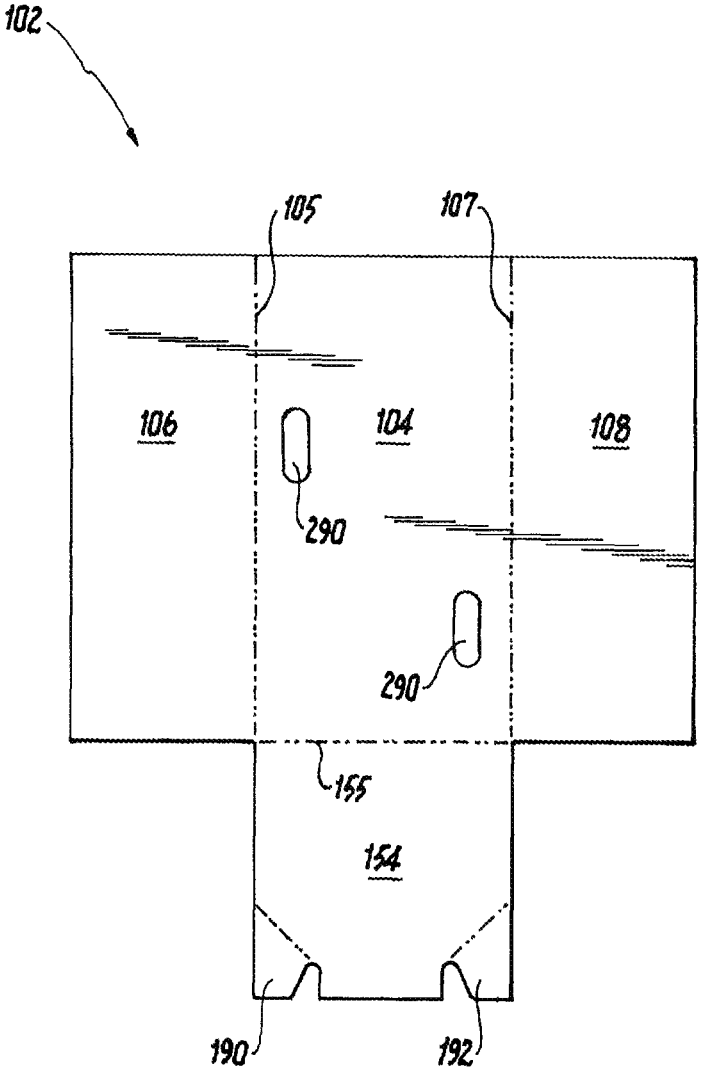
FIG. 2 is a plan view of a blank section of the container of FIG. 1.
Figure 3:
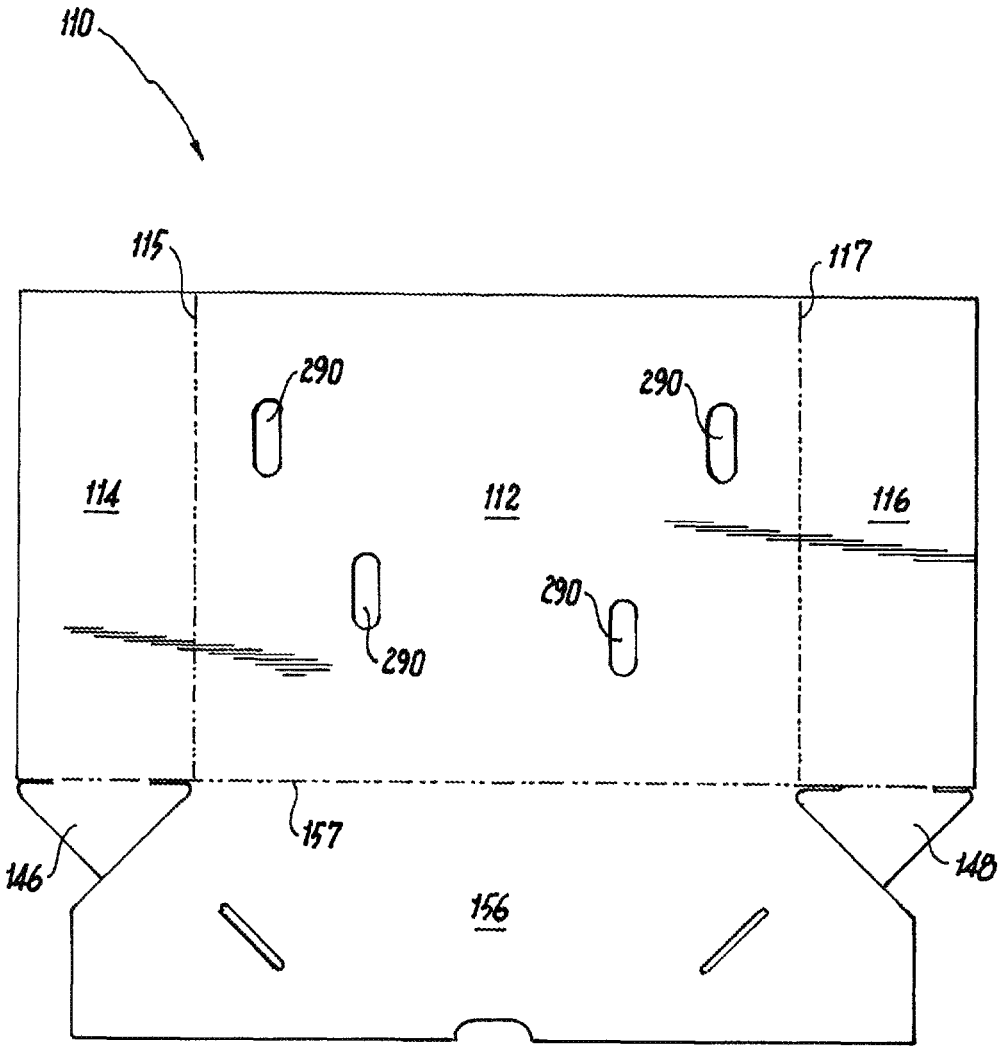
FIG. 3 is a plan view of another blank section of the container of FIG. 1.
Figure 4:
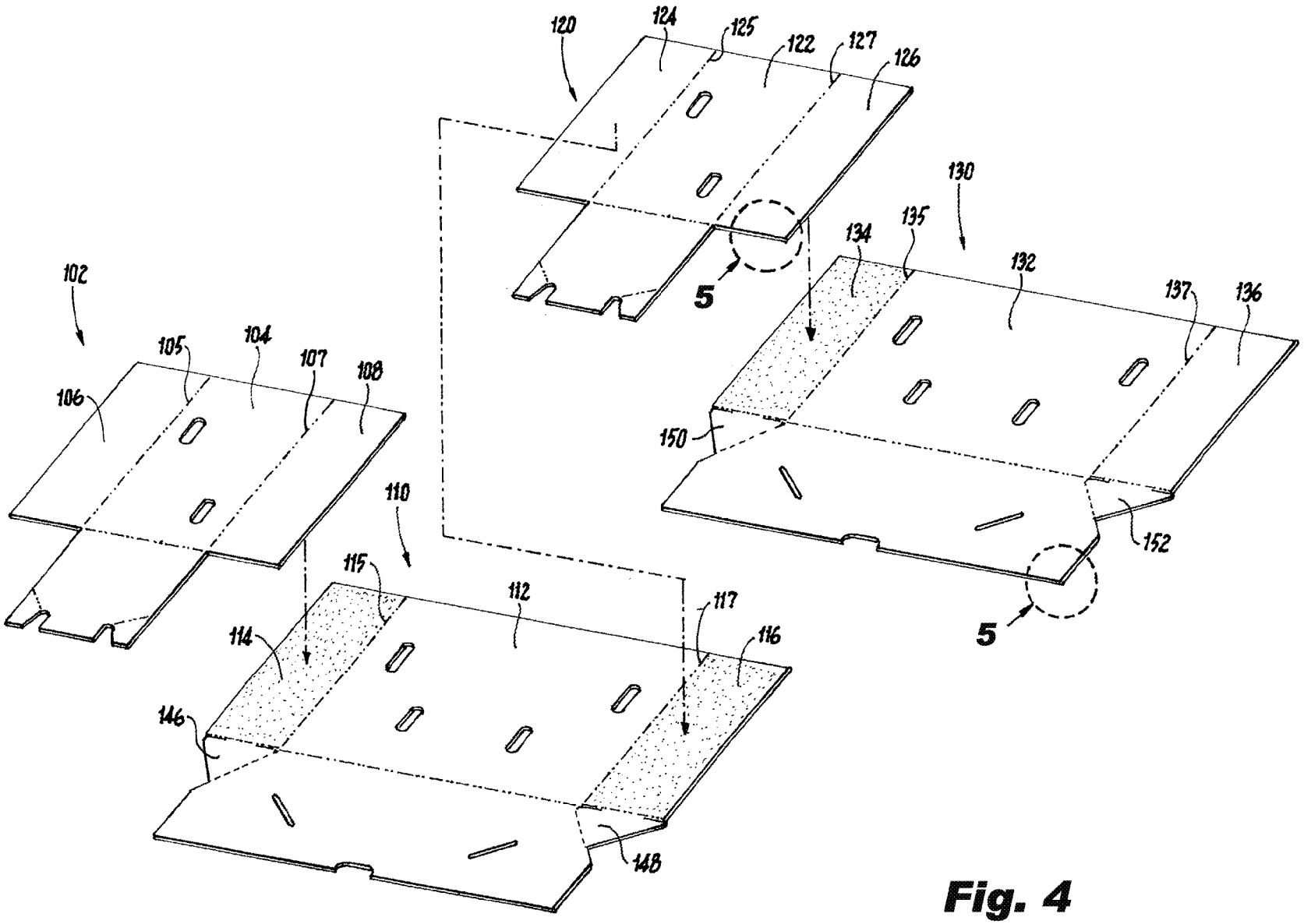
FIG. 4 is a exploded plan view of the blanks of FIGS. 2 and 3, indicating schematically how the blank portions are adhered together.

Reference will now be made to the drawings wherein like reference numerals identify similar structural features or aspects of the subject disclosure. For purposes of explanation and illustration, and not limitation, a partial view of an embodiment of a container in accordance with the disclosure is shown in FIG. 1 and is designated generally by reference character 100. Other embodiments of systems in accordance with the disclosure, or aspects thereof, are provided in FIGS. 2-16, as will be described. The systems and methods described herein can be used to form a structurally secure stackable corrugated paper container.

As shown in FIGS. 1-4, a container 100 includes a first blank section 102 including a first side panel 104 with an opposed pair of corner panels 106, 108 extending form opposite ends of the first side panel 104 along fold lines 105, 107. The container 100 includes a second blank section 110 including a front panel 112 with an opposed pair of corner panels 114, 116 extending from opposite sides of the front panel along fold lines 115, 117. One of the corner panels 106, 108 of the first side panel 104 is adhered to one of the side panels 114, 116 of the front panel 110, forming a first double-thickness corner panel 118.

The container 100 includes a third blank section 120 including a second side panel 122 opposite the first side panel 104 with an opposed pair of corner panels 124, 126 extending from opposite sides of the second side panel 122 along fold lines 125, 127. One of the corner panels 124, 126, of the second side panel 122 is adhered to one of the corner panels 114, 116 of the front panel 112, forming a second double-thickness corner panel 128.

The container 100 comprises a fourth blank section 130 including a back panel 132 with an opposed pair of corner panels 134, 136 extending from opposite sides of the back panel 132 along fold lines 135, 137. One of the corner panels 134, 136 of the back panel 132 is adhered to one of the corner panels 124, 126 of the second side panel 122, forming a third double-thickness corner panel 138. One of the corner panels 134, 136 of the back panel 132 is adhered to one of the corner panels 106, 108 of the first side panel 104, forming a fourth double thickness corner panel 140. The first side panel 104, front panel 112, second side panel 122, and back panel 132 cooperate to surround an interior space 142 for containing product, e.g. product 144 as shown in FIG. 1. Each panel 104, 112, 122, 132, can include a plurality of aeration holes 290, however, corner panels 118, 128, 138, and 140 can be void of any such holes.

Figure 5:
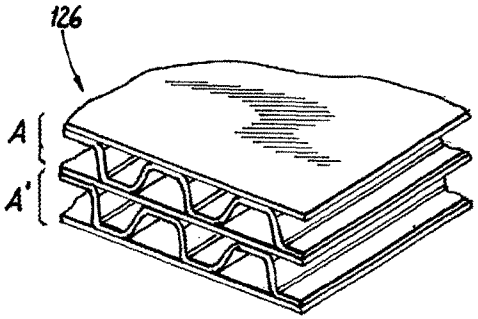
FIG. 5 is a magnified cross section of a portion of the blank of FIG. 3 showing a double wall thickness corrugate.
Figure 6:
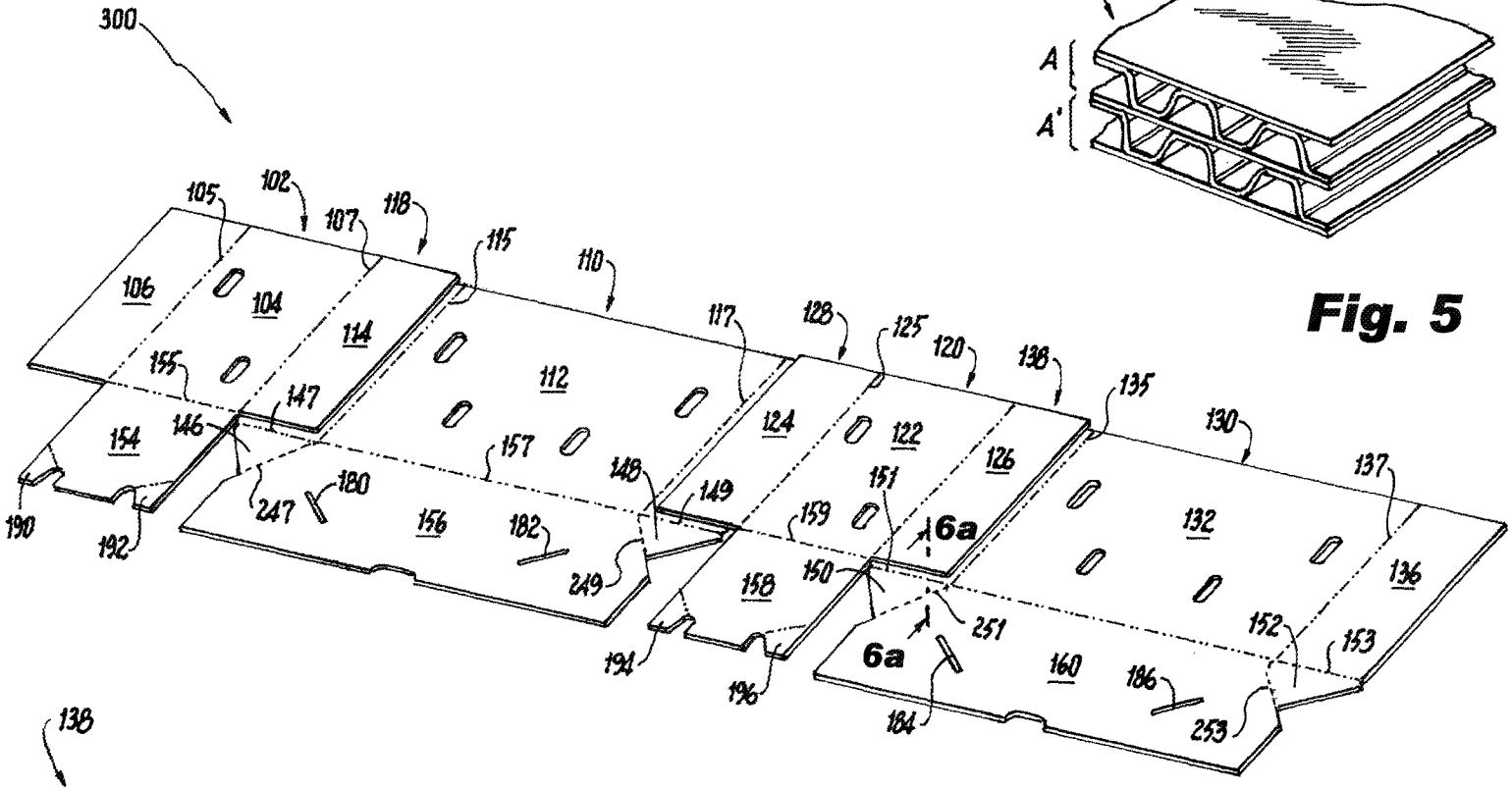
FIG. 6 is a plan view of the blanks of FIGS. 2 and 3, showing an attached blank of the container of FIG. 1.
Figure 6A:
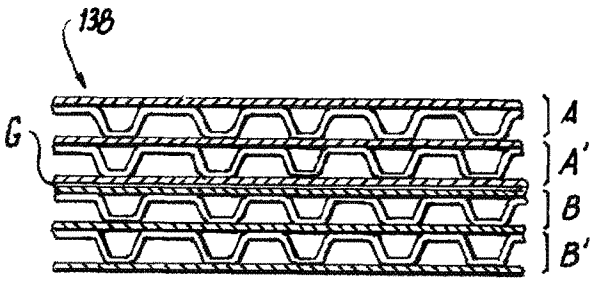
FIG. 6*a* is a magnified cross section of a portion of the attached blank of the container of FIG. 1, showing two plies of double wall thickness corrugate in the corner panels.
Figure 7:
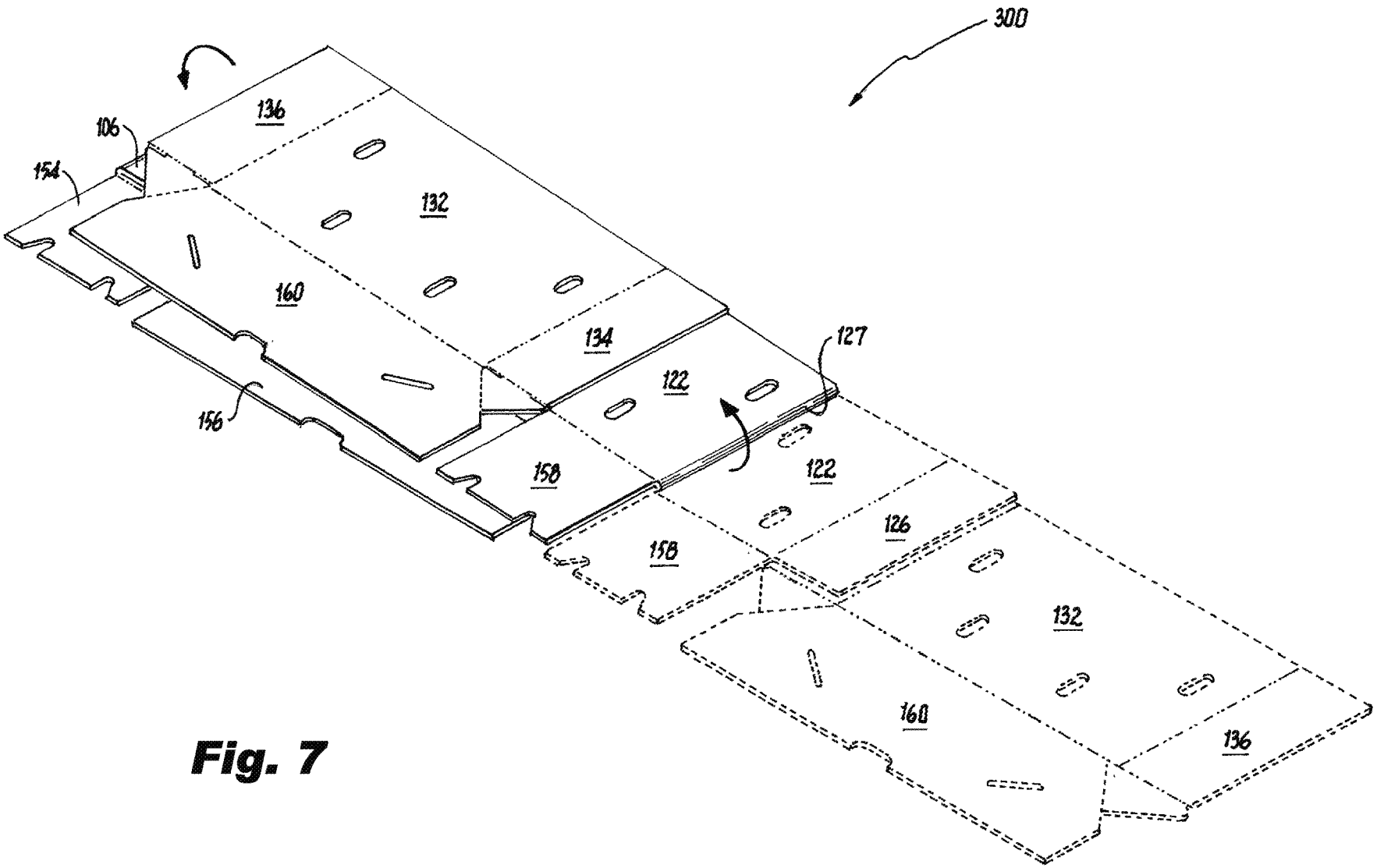
FIG. 7 is a plan view of the attached blank of FIG. 6, showing a palletizable form of the container of FIG. 1.

Each of the first 102, second 110, third 120, and fourth 130 blank sections are of double-wall corrugated paper, so that the first 118, second 128, third 138, and fourth 140 double-thickness corner panels have a total two double-wall corrugated paper for a total of four plies thickness in each corner. For example, FIG. 5 shows a magnified cross-section of a portion of second blank 110, where the paper comprises two layers (A, A') of corrugated paper. FIG. 6*a* shows a magnified cross-section of a portion of 138, where the overlap of corner panels 126 and 134 for example, form two layers of double wall (A, B) with an adhesive layer G in between, totaling 4 plies of corrugated paper (A, A', B, B'). Each corner panel 114, 116, 134, 136 of the front and back panels 112, 132 can include a triangular bottom flap 146, 148, 150, 152 extending outward from the respective double-wall thickness corner panels 118, 138, 138, and 140 along fold lines 147, 149, 151, and 153 respectively (e.g. as best seen in FIG. 6). The first side panel 104, front panel 112, second side panel 122, and back panel 132 can be folded into a flat, palletizable form configured to be erected into the container 100 (e.g. as shown in FIG. 7).

The container 100 further includes, a first bottom flap 154 extending from a bottom edge (corresponding to fold line 155) of the first side panel 104, a second bottom flap 156 extending from a bottom edge (corresponding to fold line 157) of the front panel 112, a third bottom flap 158 extending from a bottom edge (corresponding to fold line 159) of the second side panel 122, and a fourth bottom flap 160 extending from a bottom edge (corresponding to fold line 161) of the back panel 132. The first 154, second 156, third 158, and fourth 160 bottom flaps fold inward along their respective fold lines 155, 157, 159, and 161 to overlap and form a bottom panel 162, e.g. as shown in FIGS. 8-9.

The top edges 164, 166, 168, 170 of the first side panel 104, front panel 112, second side panel 122, and back panel 132 form a top opening 172 into the interior space 142. The top edges 164, 166, 168, 170 can be free of panels extending therefrom.

Figure 10:
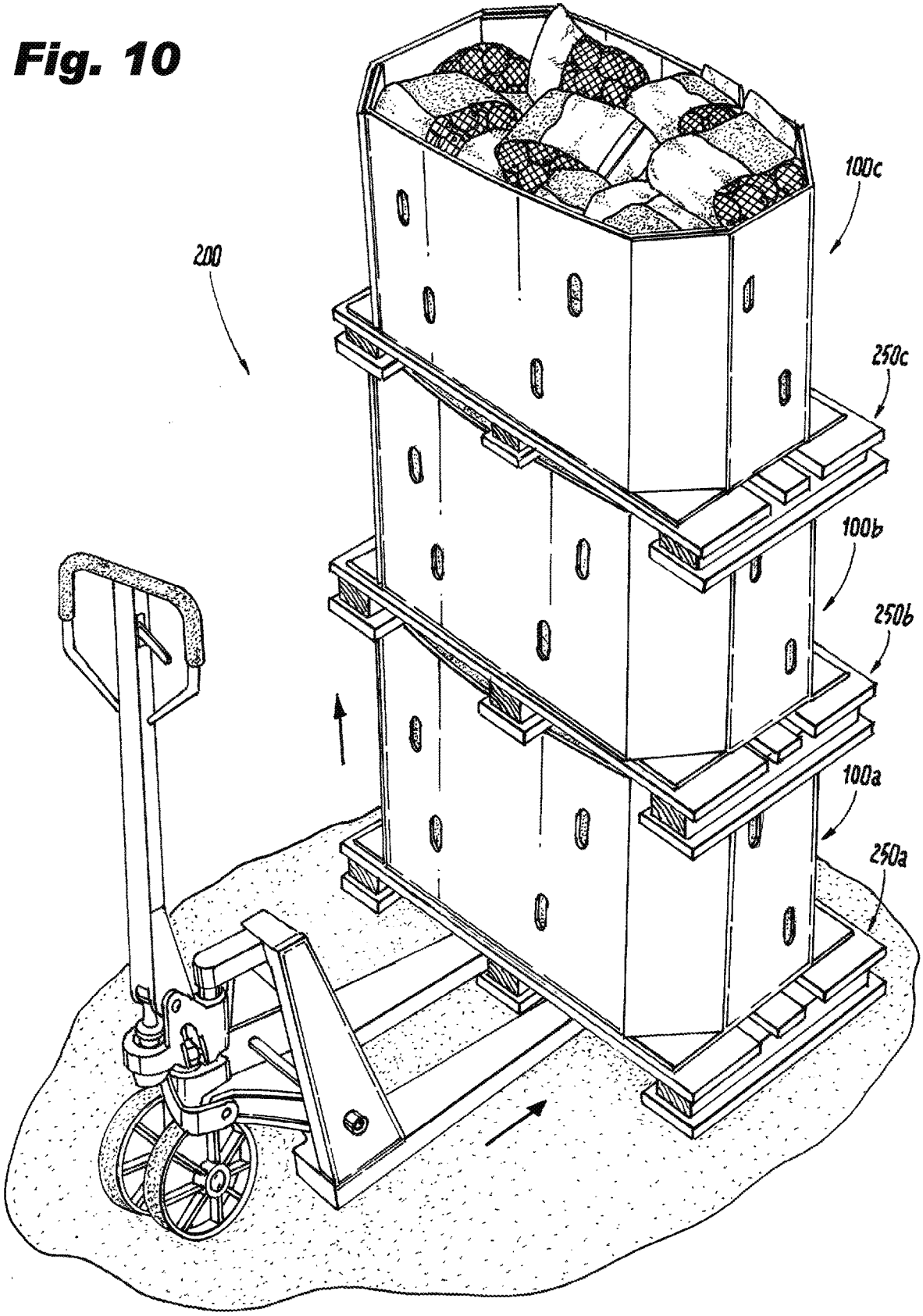
FIG. 10 is a perspective view of a system constructed in accordance with the present disclosure, showing a plurality of stacked containers of FIG. 1 holding a product.
Figure 11:
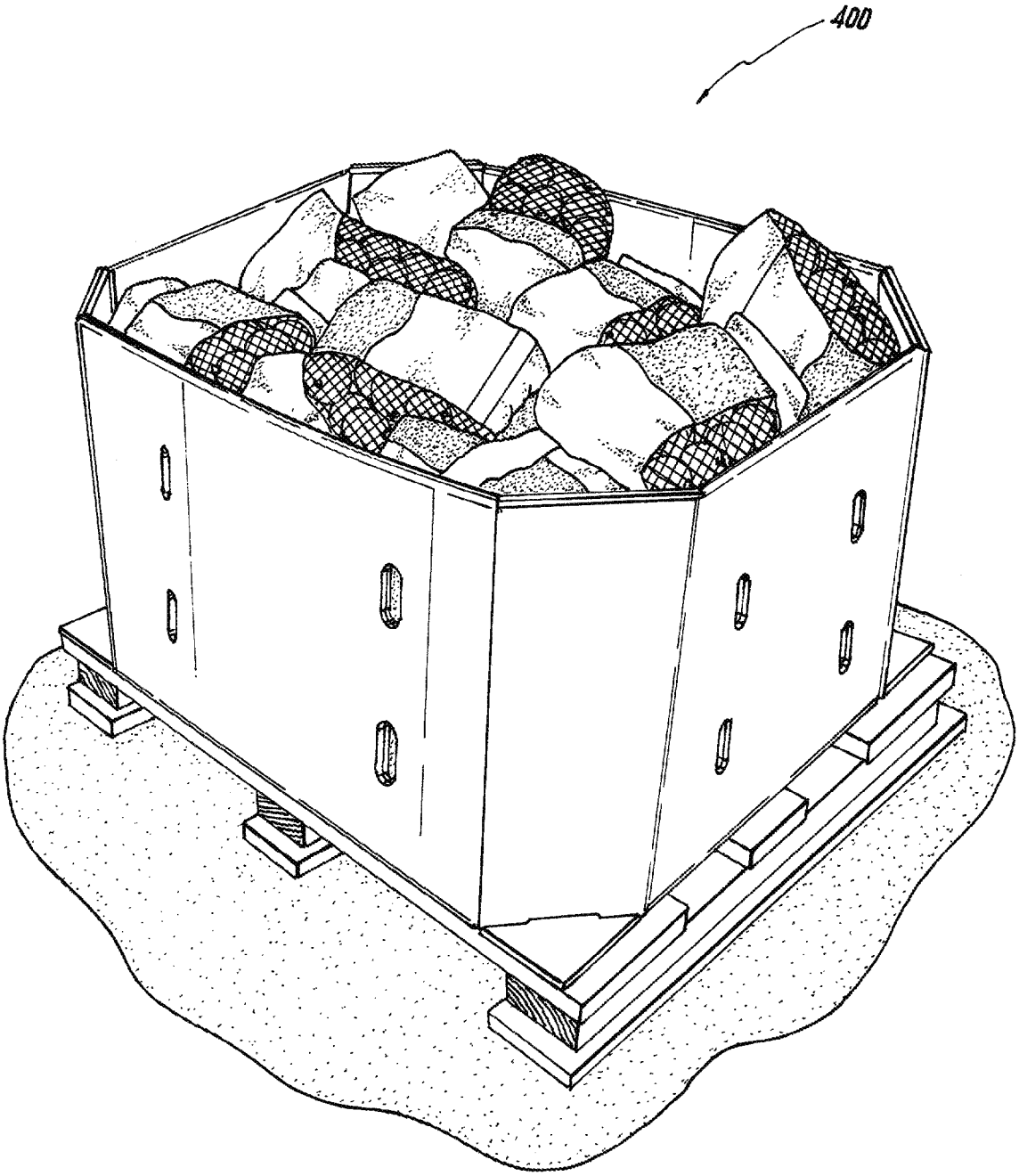
FIG. 11 is a perspective view of another container constructed in accordance with the present disclosure, in which both interior and exterior surfaces can have printed material even though only one side of the blank is printed.
Figure 12:
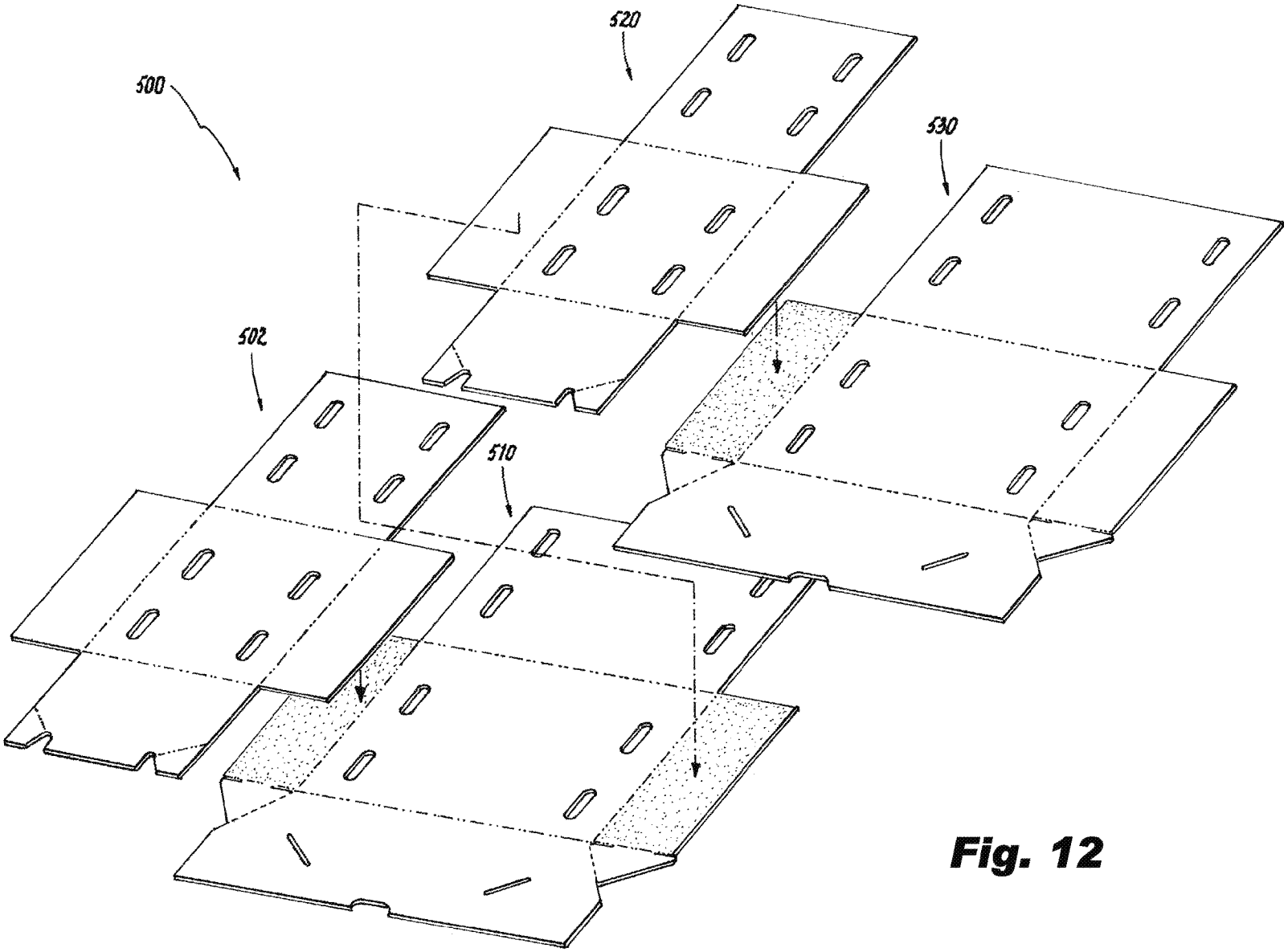
FIG. 12 is a exploded plan view of the blanks, indicating schematically how the blank portions are adhered together.
Figure 13:
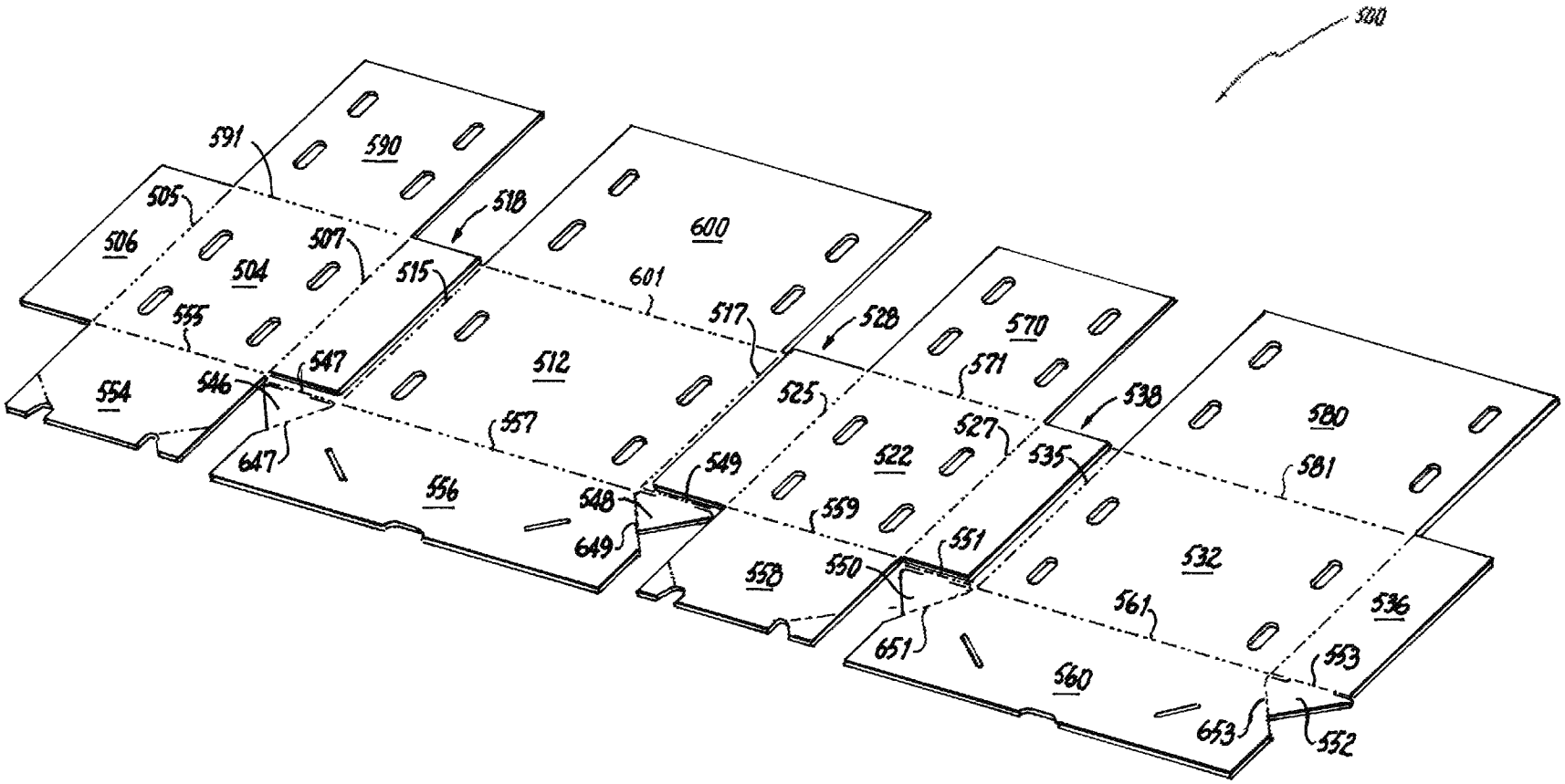
FIG. 13 is a plan view of an attached blank version of the container of FIG. 11.

As shown in FIG. 10, a system 200 comprises, a container 100 including four of upright panels (corresponding to blanks 102, 110, 120, and 130) formed about an interior space 144, wherein the upright panels are connected by four corner panels (corresponding to corner panels 118, 128, 138, and 140), wherein the four upright panels and the four corner panels are of double wall corrugated paper and are configured to support a load of 1200 pounds (544 kg) bearing down on the four upright panels and the four corner panels.

In the system 200, the container 100 is a first container 100*a* and further includes a pallet 250*a* on top of the first container 100*a* and a second container 100*b* on top of the pallet. The pallet 250*a* and second container 100*b* can weigh at least 1200 pounds (544 kg). In the system, the pallet 250*a* can be a first pallet and can further include a second pallet 250*b* on top of the second container 100*b* and a third container 100*c* on top of the second pallet 250*b*. The second pallet 250*b* and third container 100*c* can weigh at least 1200 pounds (544 kg). For example, the containers 100*a*-100*c* can be stacked atop one another in the direction of the upward pointing arrow shown in FIG. 10. The first container 100*a* can be free of triple wall corrugated material, however it is appreciated that any or all of containers 100*a*-100*c* can be free of triple wall corrugated material. It is contemplated that blanks 200 and 500 can form a container having a footprint sized to fit a standard full sized pallet, however, blanks 200 and 500 can also form a container having a footprint that is half of a standard pallet, or any other size desired.

Referring back to FIGS. 2-4, a blank 300 as described above is folded into a container 100 by folding first side panel 104 inward along fold line 107, folding front panel 112 inward along fold lines 115 and 117, folding second side panel 122 inward along fold lines 125 and 127, folding back panel 132 inward along fold lines 135 and 137 to join corner panel 136 of the back panel 132 with corner panel 106 of first side panel around an interior space. Bottom flaps 154, 156, 158, and 160 can be folded inward along fold lines 155, 157, 159, and 161 to create a bottom panel. Bottom flaps 156 and 160 further include slots 180, 182, 184, and 186 configured to engage tabs 190, 192, 194, and 196 of bottom flaps 154 and 158 respectively.

When folding bottom flaps 156 and 160 inwards, triangular bottom flaps 146, 148, 150, 152 are configured to detach from bottom flaps 156 and 160 along cut lines 247, 249, 251, and 253, and extend outward from the interior space 144 along fold lines 147, 149, 151, and 153. It is appreciated that cut lines 247, 249, 251, and 253 may be pre-cut, perforated, or any other suitable line of weakness easily breakable during folding.

FIGS. 11-16 show another container 400 formed from a blank 500. Container 400 is substantially similar to that of container 100, and can be formed and folded in a substantially similar manner. Container 400 and blank 500 include, a first blank section 502 including a first side panel 504 with an opposed pair of corner panels 506, 508 extending form opposite ends of the first side panel 504 along fold lines 505, 507. The container 400 and blank 500 include a second blank section 510 including a front panel 512 with an opposed pair of corner panels 514, 516 extending from opposite sides of the front panel along fold lines 515, 517. One of the corner panels 506, 508 of the first side panel 504 is adhered to one of the side panels 514, 516 of the front panel 510, forming a first double-thickness corner panel 518.

Figure 14:
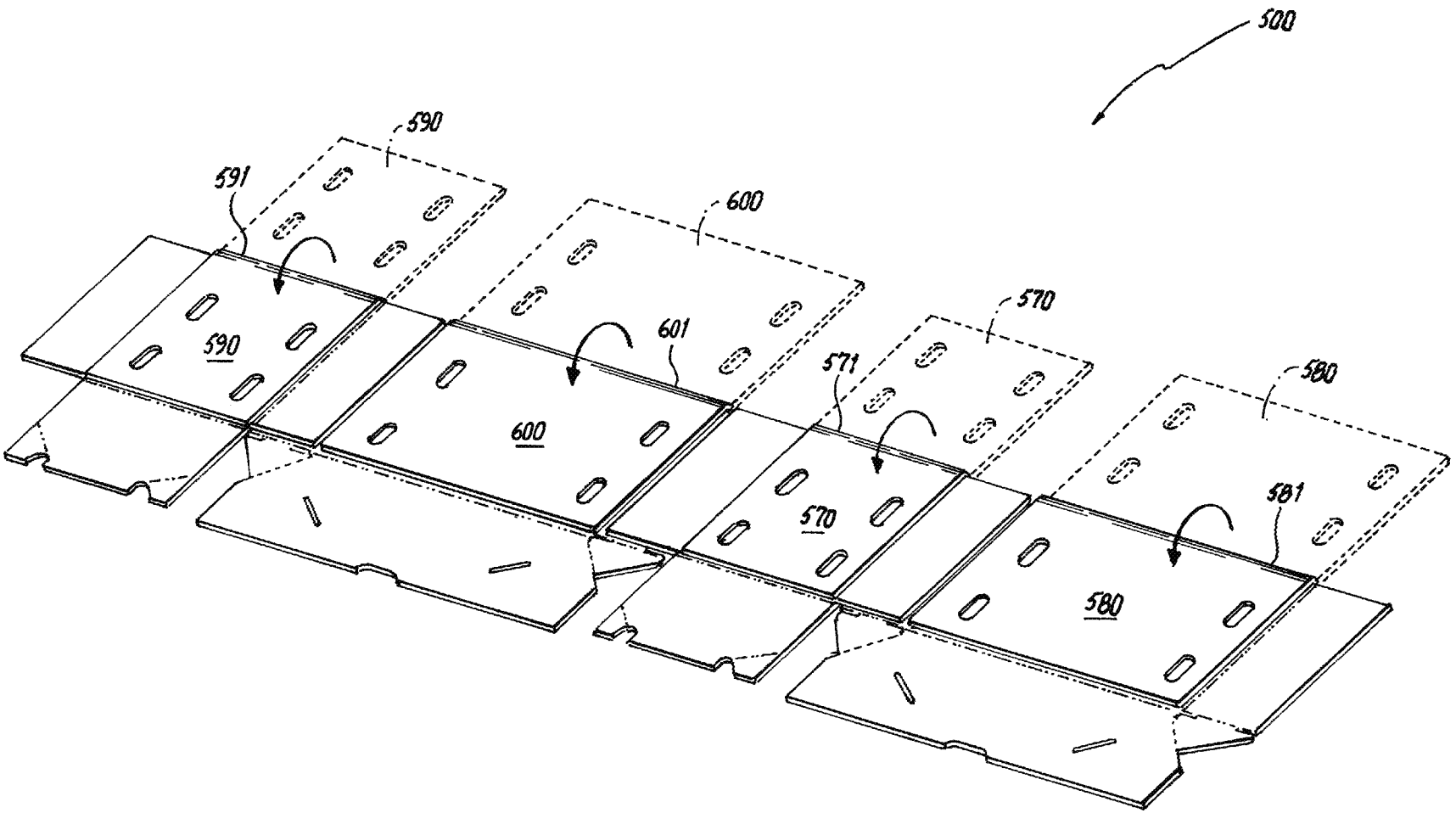
FIG. 14 is a schematic plan view of the blanks of FIG. 12, showing the formation of two layers of double wall corrugate walls, e.g. to place printed material inside the interior space in a final container.

Panels 590, 600, 570, 580 can extend upwards from panels 504, 512, 522, 532 along fold lines 591, 601, 571, 581 respectively, and fold inward towards an interior of the container 400 (e.g. as shown in FIG. 14) so that all panels include two layers of double wall thickness corrugate. Print can appear on interior 172 (e.g. panels 590, 600, 570, 580) and exterior 174 (e.g. panels 504, 512, 522, 532) surfaces of the container 400. In this way, only one side of the first 502, second 510, third 520, and fourth 530 blank sections need be printed.

In container 400, panels 504, 512, 522, and 532, and corners 518, 528, 538, and 540 all comprise two layers of double wall thickness corrugate. In addition to printing, having all panels include two layers of double wall thickness corrugate provides for added strength and stability of container 400 during stacking (e.g. stacking as shown in FIG. 10 with respect to container 100), storage, transport, or in use.

The methods and systems of the present disclosure, as described above and shown in the drawings, provide for stronger stackable containers without the need for triple wall thickness corrugate. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A container comprising:

a first blank section including a first side panel with an opposed pair of corner panels extending form opposite ends of the first side panel;

a second blank section including a front panel with an opposed pair of corner panels extending from opposite sides of the front panel, wherein one of the corner panels of the first side panel is adhered to one of the side panels of the front panel, forming a first double-thickness corner panel;

a third blank section including a second side panel opposite the first side panel with an opposed pair of corner panels extending from opposite sides of the second side panel, wherein one of the corner panels of the second side panel is adhered to one of the corner panels of the front panel, forming a second double-thickness corner panel; and a fourth blank section including a back panel with an opposed pair of corner panels extending from opposite sides of the back panel, wherein one of the corner panels of the back panel is adhered to one of the corner panels of the second side panel, forming a third double-thickness corner panel, and wherein one of the corner panels of the back panel is adhered to one of the corner panels of the first side panel, forming a fourth double thickness corner panel, and wherein the first side panel, front panel, second side panel, and back panel cooperate to surround an interior space for containing product.

2. The container as recited in claim 1, wherein each of the first, second, third, and fourth blank sections is of double-wall corrugated paper, so that the first, second, third, and fourth double-thickness corner panels have a total two double-wall corrugated paper for a total of four plies thickness in each corner.

3. The container as recited in claim 1, wherein each corner panel of the front and back panels includes a triangular bottom flap extending outward from the respective double-wall thickness corner panel.

4. The container as recited in claim 1, further comprising:

a first bottom flap extending from a bottom edge of the first side panel;

a second bottom flap extending from a bottom edge of the front panel;

a third bottom flap extending from a bottom edge of the second side panel; and a fourth bottom flap extending from a bottom edge of the back panel, wherein the first, second, third, and fourth bottom flaps overlap to form a bottom panel.

5. The container as recited in claim 4, wherein top edges of the first side panel, front panel, second side panel, and back panel form an top opening into the interior space.

6. The container as recited in claim 5, wherein the top edges are free of panels extending therefrom.

7. The container as recited in claim 5, wherein at least one of the top edges includes an interior panel extending from the top edge and folded over into the interior space, so print can appear on interior and exterior surfaces of the container while only one side of the first, second, third, and fourth blank sections need be printed.

8. A blank comprising:

a first blank section including a first side panel with an opposed pair of corner panels extending form opposite ends of the first side panel;

a second blank section including a front panel with an opposed pair of corner panels extending from opposite sides of the front panel, wherein one of the corner panels of the first side panel is adhered to one of the side panels of the front panel, forming a first double-thickness corner panel;

a third blank section including a second side panel opposite the first side panel with an opposed pair of corner panels extending from opposite sides of the second side panel, wherein one of the corner panels of the second side panel is adhered to one of the corner panels of the front panel, forming a second double-thickness corner panel;

a fourth blank section including a back panel with an opposed pair of corner panels extending from opposite sides of the back panel, wherein one of the corner panels of the back panel is adhered to one of the corner panels of the second side panel, forming a third double-thickness corner panel, and wherein one of the corner panels of the back panel is configured to be adhered to one of the corner panels of the first side panel, forming a fourth double thickness corner panel, and wherein the first side panel, front panel, second side panel, and back panel are configured to cooperate to surround an interior space for containing product.

9. The blank as recited in claim 8, wherein each of the first, second, third, and fourth blank sections is of double-wall corrugated paper, so that the first, second, and third double-thickness corner panels have a total two double-wall corrugated paper for a total of four plies thickness.

10. The blank as recited in claim 8, wherein each corner panel of the front and back panels includes a triangular bottom flap extending outward therefrom.

11. The blank as recited in claim 8, further comprising:

a first bottom flap extending from a bottom edge of the first side panel;

a second bottom flap extending from a bottom edge of the front panel;

a third bottom flap extending from a bottom edge of the second side panel; and a fourth bottom flap extending from a bottom edge of the back panel, wherein the first, second, third, and fourth bottom flaps are configured to overlap to form a bottom panel.

12. The blank as recited in claim 11, wherein top edges of the first side panel, front panel, second side panel, and back panel are free of panels extending therefrom.

13. The blank as recited in claim 11, wherein at least one of top edges of the first side panel, front panel, second side panel, and back panel includes an interior panel extending from the top edge and folded over into the interior space, so print can appear on interior and exterior surfaces of the container while only one side of the first, second, third, and fourth blank sections need be printed.

14. The blank as recited in claim 8, wherein one of the corner panels of the back panel is configured to be adhered to one of the corner panels of the first side panel, forming a fourth double thickness corner panel.

15. The blank as recited in claim 14, wherein the first side panel, front panel, second side panel, and back panel are folded into a flat, palletizable form configured to be erected into a container.

16. The blank as recited in claim 8, wherein each of the first, second, third, and fourth blank portions are devoid of triple wall corrugated paper.

* * * * *